United States Patent [19]

Okabe et al.

[11] 4,089,263

[45] May 16, 1978

[54] IMPACT PRINTER

[75] Inventors: Katsuhiko Okabe, Tokorozawa; Yoshiyuki Sudo, Yono, both of Japan

[73] Assignee: Copal Company Limited, Tokyo, Japan

[21] Appl. No.: 767,618

[22] Filed: Feb. 10, 1977

[30] Foreign Application Priority Data

Feb. 12, 1976 Japan ..... 51-15264[U]

[51] Int. Cl.[2] ..... B41J 9/10; B41J 9/36

[52] U.S. Cl. ..... 101/93.33; 400/152; 400/157.2

[58] Field of Search ..... 101/93.30, 93.31; 197/49

[56] References Cited

U.S. PATENT DOCUMENTS

| | | | |
|---|---|---|---|
| 3,795,187 | 3/1974 | Babler | 101/93.14 |
| 3,822,641 | 7/1974 | Babler | 101/93.31 |
| 3,832,942 | 9/1974 | Murayoshi | 101/93.31 |

FOREIGN PATENT DOCUMENTS

| | | | |
|---|---|---|---|
| 2,322,285 | 11/1973 | Germany | 101/93.30 |

*Primary Examiner*—Paul T. Sewell
*Attorney, Agent, or Firm*—J. Harold Nissen

[57] ABSTRACT

An impact printer in which a printing drum having a plurality of lines each containing different characters is associated with printing hammers. The printing hammers are driven into contact with the characters by a driving shaft having a driving projection thereon. The driving projection is separated into driving projection sections which are axially and radially displaced along the driving shaft. Each section will selectively engage different printing hammers so that all hammers will not operate at once for the same characters. The characters in the lines are also displaced angularly of the printing drum so that some of the characters in one line will be printed responsive to one driving projection and the other characters in the one line will be printed in response to the other driving projection section.

4 Claims, 4 Drawing Figures

IMPACT PRINTER

BRIEF SUMMARY OF THE INVENTION

The impact printer has a rotating printing drum bearing a plurality of axially extending rows of printing characters circumferentially arranged on the peripheral surface of the drum, the characters in any one row being identical to each other but the characters in the respective row being different from those in other rows, a driving shaft adapted to be driven at a speed in synchronism with the drum so that it rotates one revolution during the time until the succeeding row is brought to the printing position of the printer for the printing operation after the preceding row has been moved thereto for the printing operation and moved away therefrom, printing hammers each belonging to the respective character in each row for printing the character at the printing position when actuated, control members each belonging to the respective printing hammer for actuating the same when driven, the driving shaft having driving projection means for driving the respective control members, the control members being normally held apart from the driving projection means so that it is inoperative by the driving projection means but, when the operator manipulates the printer for the required printing, the control members are brought to the positions at which they are driven by the driving projection means thereby permitting the required printing operation to be effected. In order to reduce the instantaneous excessive power as is required for the simultaneous printing of the same characters in one row of the printing resulting in too light printing, the driving projection means of the driving shaft is divided into at least two portions shifted their angular phase slightly from each other so that some of the control members are driven in retard of the actuation of the remainder of the control members so as to avoid the simultaneous excessive power for the printing operation while the location of the printed characters in one row is substantially held in alignment with each other.

BACKGROUND OF THE INVENTION

The present invention relates to an impact printer and, more particularly, to an impact printer in which the instantaneous excessive power required for the actuation of the printing hammers is greatly reduced.

In a so-called impact printer having a rotating drum bearing thereon a plurality of axially extending rows of printing characters each of which rows consists of a plurality of the same characters with each other but different from those in other rows, printing hammers each belonging to the respective character in each row and kicking members adapted to be rotated at all times during the operation of the printer each belonging to the respective hammer, the hammers are selectively brought into operative position by the kicking members upon manipulation of the printer for the required printing operation so that the hammers are struck by the kicking members thereby permitting the required printing to be given in the recording paper by the actuation of the hammers.

In such a type of the impact printer, the hammers are selectively struck according to the manipulation of the printer when the each selected row of the required characters passes the printing position of the printer at which the respective hammer strikes the drum with the paper held therebetween during one revolution of the printing drum thereby completing the printing of one row.

Therefore, in case all the characters to be printed in one and the same row are the same with each other, all the printing hammers must be struck simultaneously by the kicking members for the respective printing hammers so that instantaneous excessive power is required for properly actuating the respective hammers otherwise the striking force of the hammers is made weak resulting in light printing of the characters.

SUMMARY OF THE INVENTION

The object of the present invention is, therefore, to avoid the above described disadvantages of the prior art impact printer and to provide a novel and useful impact printer of the type as described above in which the power required for the proper printing is widely reduced even though all the characters to be printed in one and the same row are the same with each other without deteriorating the quality of the printing obtained.

The above object is achieved in accordance with the present invention by the provision of an impact printer in which the kicking members are shifted in their angular phases slightly from each other thereby avoiding the simultaneous operation of the hammers even though all the characters to be printed in one row are the same with each other while the alignment of the printed characters in one row is substantially held properly.

DETAILED DESCRIPTION OF THE PREFERRED EMBODIMENT

Figure 1:
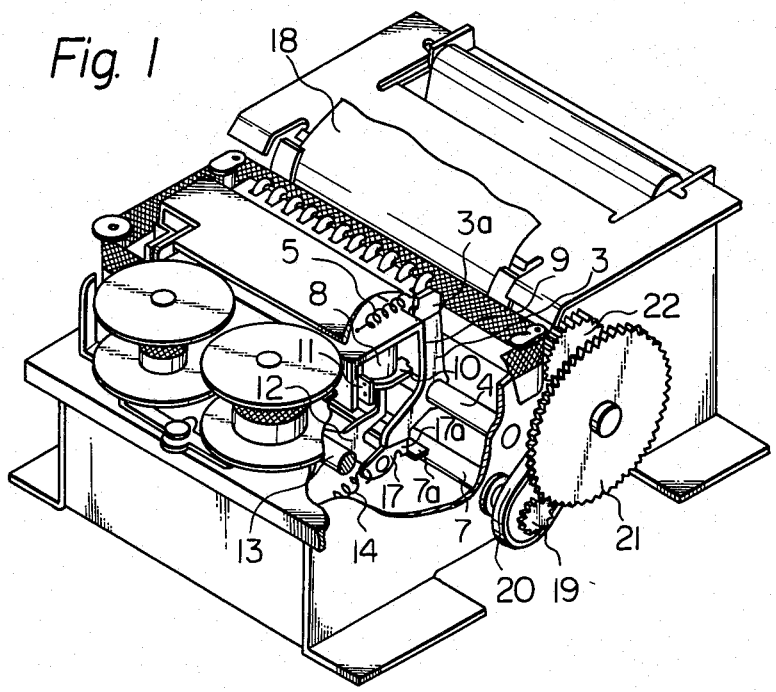
FIG. 1 is a general perspective view showing an impact printer embodying the present invention.
Figure 2:
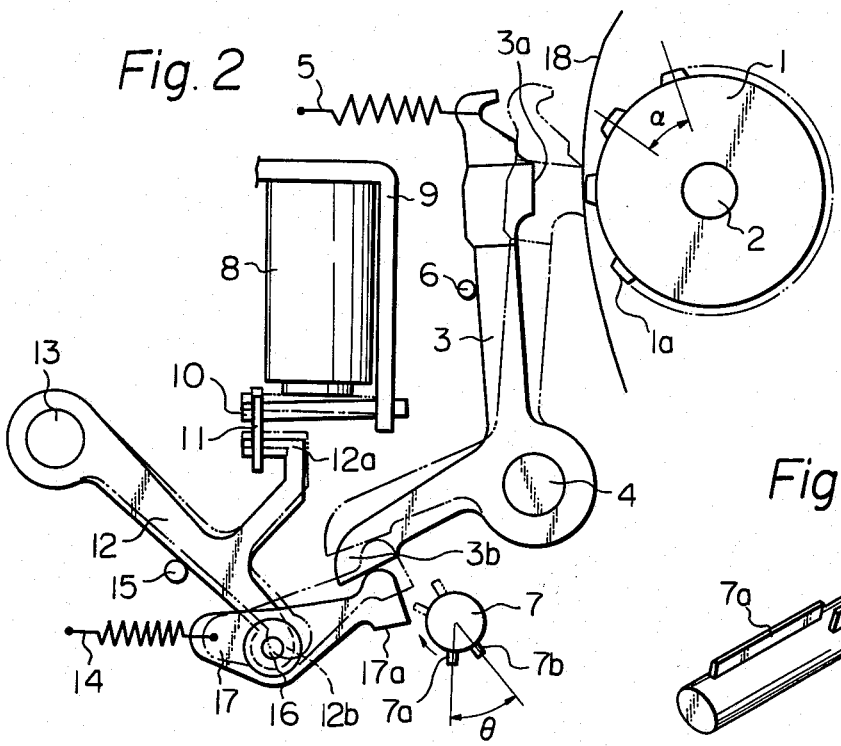
FIG. 2 is a schematic side view showing the main portions of the printer shown in FIG. 1.

In FIG. 1 showing the impact printer of the present invention, the printing drum 1 (not shown in this figure but shown in FIG. 2) is integrally attached to a shaft 2 (FIG. 2) to which a gear 22 is secured which gear 22 is driven together with the printing drum 1 at all times during the operation of the printer through a gear train including a pinion 19, a gear 21 and a gear (not shown) integral with the gear 21 by a belt 20 which is driven by a motor not shown. The printing drum 1 bears a plurality of axially extending rows of printing characters 1*a* (FIG. 2) arranged circumferentially on the peripheral surface of the drum with the angular phase difference $\alpha$ held between the adjacent rows as shown in FIG. 2. All the characters 1*a* in one row are identical with each other but different from those in other rows.

Printing hammers 3 each belonging to the respective characters in each row are rotatably supported by a shaft 4 secured to the frame of the printer.

Each of the printing hammers 3 is selectively actuated to strike the printing drum 1 for the printing operation by the respective control means consisting of a control lever 17 and a select lever 12 to which the control lever 17 is pivoted, the select lever 12 per se being pivoted to a shaft 13 secured to the frame of the printer. Thus, each of the control means is so actuated that, upon manipulation of the printer to issue the printing demand signal, selected one or ones of electromagnets 8 each belonging to the respective control means are energized so as to bring the corresponding control levers 17 into the positions at which the same are driven or kicked by driving projection means or kicking members 7a secured to a driving shaft 7 to which the pinion 19 is integrally secured so as to drive the shaft 7 at all times in synchronism with the printing drum 1 during the operation of the printer at a speed at which the driving shaft 7 is rotated one revolution during the time the drum 1 is rotated by the angle of $\alpha$, i.e. during the time until the succeeding row of the drum reaches the printing position at which the printing hammer 3 strikes the drum 1 after the preceding row has been struck by the printing hammer at the printing position, thereby effecting the printing by the hammers onto the recording paper 18 interposed between the drum 1 and the hammers 3.

The timing of the actuation of the control levers 17 by the driving projection means 7a of the driving shaft 7 is so selected that the hammers strike the selected row of the printing drum 1 which is just brought to the printing position during the rotation of the drum 1.

Figure 3:
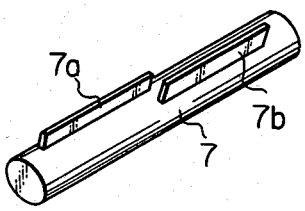
FIG. 3 is a perspective view showing the kicking members of the present invention.

Now, the present invention will be described in detail with reference to FIGS. 2 and 3.

As described previously, the printing drum 1 bearing thereon a plurality of rows of characters 1a with the angular phase $\alpha$ held between the adjacent rows is driven by the shaft 2 secured thereto. Each of the printing hammers 3 corresponding to the respective character in each row is rotatably supported by the shaft 4 and is formed with a striking surface 3a for striking the drum 1 and an arm 3b adapted to be driven by the control lever 17 when it is brought to the operative position as described later. Each of the hammers 3 is energized by a spring 5 in the counterclockwise direction in FIG. 2 and held by a stopper 6 at a position at which the striking surface 3a is held apart from the periphery of the printing drum 1.

The driving shaft 7 having the driving projection means is rotated in synchronism with the drum 1 as previously described.

Each of the select levers 12 pivoted on the shaft 13 is formed with an arm 12a connected through a connecting lever 11 to an armature 10 of the electromagnet 8, the armature 10 being swingably supported by a frame 9 of the printer so that, when the magnet 8 is energized the lever 12 is attracted in the counterclockwise direction in FIG. 2. The control lever 17 is pivoted to the respective select lever 12 by a pin 16 is formed with an abutment surface 17a adapted to cooperate with the driving projection means 7a of the driving shaft 7, the side edge opposite to the abutment surface 17a being adapted to strike the arm 3b of the printing hammer 3, when actuated. Each of the control levers 17 is energized by a spring 14 so as to be biased toward the left in FIG. 2 together with the select lever 12 and stopped by a stopper 15 so that each of the control levers 17 is normally held at a position at which the abutment surface 17a is held out of the path of movement of the driving projection means 7a of the driving shaft 7.

Thus, when the electromagnet 8 is energized, the select lever 12 is moved in the counterclockwise direction together with the control lever 17 against the action of the spring 14 so that the abutment surface 17a is moved into the path of movement of the driving projection means 7a so as to be struck by the projection means 7a for striking the arm 3b of the printing hammer 3 thereby effecting the printing by the printing hammer.

In such a construction, if all the characters to be printed in one and the same row of the printing is the same with each other, all the printing hammers 3, and, hence, the control levers 17 and the select levers 12 must be actuated simultaneously by the simultaneous energization of all the magnets 8 because the characters in one row are identical to each other with the characters in each row being different from other rows, thereby requiring instantaneous excessive power or rendering the striking force of the hammers 3 to be weak resulting in too light printing quality.

In accordance with the present invention, in order to avoid such excessive power, the driving projection means 7a is divided into at least two sections 7a, 7b angularly shifted from each other by a slight angle $\theta$ so that the control levers 17 and, hence, the printing hammers 3 belonging to the section 7b of the driving projection means are actuated slightly in retard of the actuation of those belonging to the section 7a so as to avoid the simultaneous actuation of the hammers 3 even though all the characters to be printed in one row are the same with each other and reduce the peak of the power required for such printing.

In accordance with the present invention, the numbers of the sections 7a, 7b may be made more than two so as to further average the power.

In accordance with the present invention, the arrangement of the characters in each row belonging to the section 7b may be angularly shifted from those belonging to the section 7a correspondingly to the phase angle $\theta$ between the sections 7a, 7b, so that the characters printed in one row can be strictly in alignment with each other.

In operation, the drum 1 and the driving shaft 7 are first rotated. Upon issuance of the printing demand signal by the manipulation of the printer, the selected magnets 8 are energized each time immediately before the respective selected row of characters reaches the printing position, so that the armatures 10 are attracted to actuate the respective select levers 12 so as to bring the control levers 17 into operative position by the driving projection means 7a, 7b of the driving shaft 7, thereby permitting the respective printing hammers 3 to strike the selected row of characters with the paper 18 interposed therebetween for effecting the desired printing operation. Since the sections 7a and 7b of the driving projection means are angularly shifted from each other, the instantaneous excessive power as required in case all the characters to be printed in one row are the same with each other requiring the simultaneous actuation of all the hammers is greatly reduced.

Therefore, the load to the driving motor is reduced enabling the use of small capacity motor while too light printing quality is positively avoided.

Figure 4:
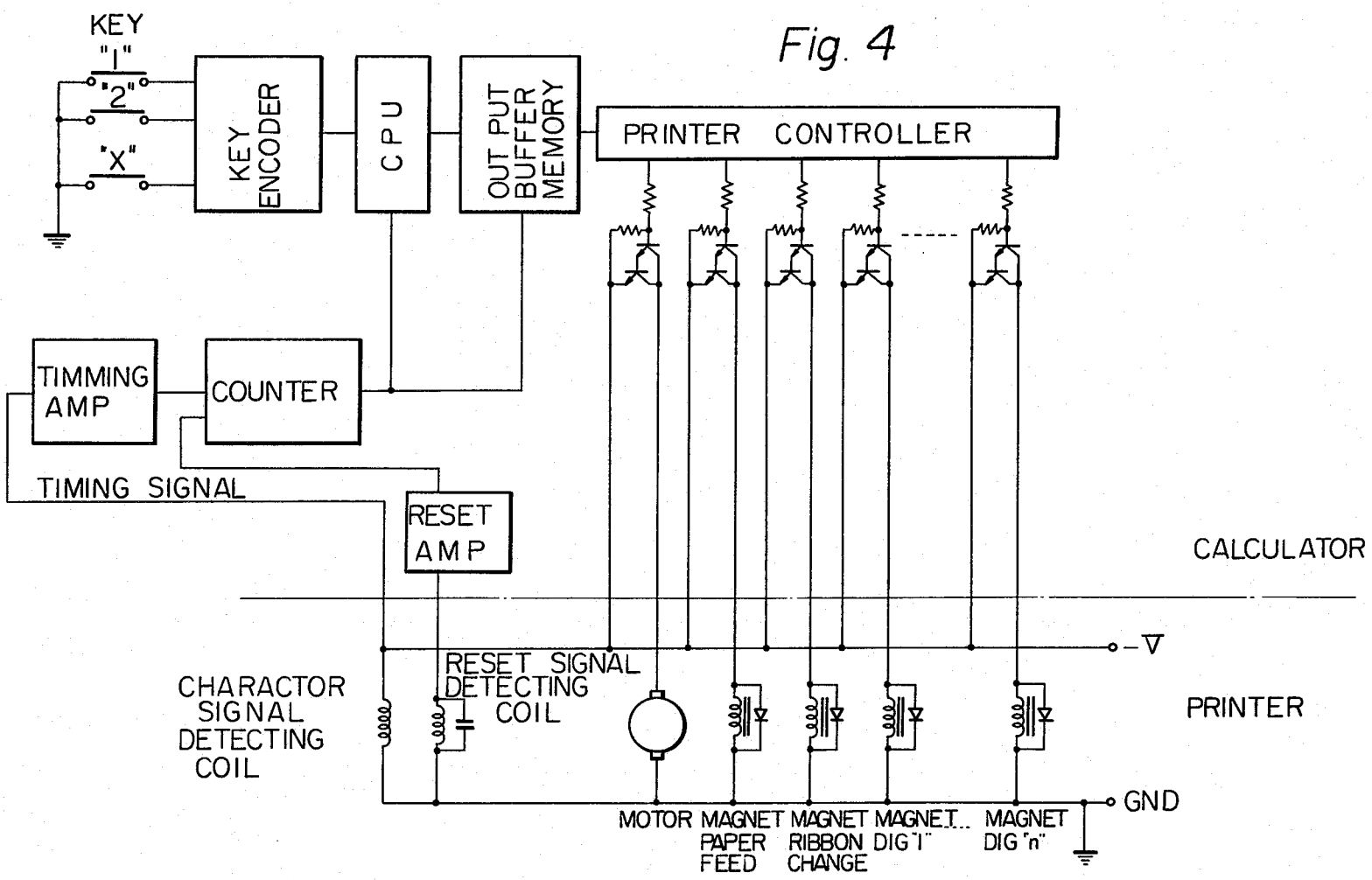
FIG. 4 is a block diagram showing the control circuit of the printer shown in FIG. 1.

FIG. 4 shows an example of the control circuit for use with the printer described above.

Briefly speaking, upon manipulation of KEYs, the KEY ENCODER (usually made of diode matrix) encodes the input from the KEYs and issues an output to CPU (Center Processing Unit) for the operation thereof.

The output of CPU is received by OUTPUT BUFFER MEMORY so as to memorize the printing data in conformance with the operation of the printer.

The PRINTER CONTROLLER receives the output of data signals from OUTPUT BUFFER MEMORY and converts the data signals to the printer driving signals so as to be amplified by DRIVER TRANSISTORs so that the driving of the printer is thereby made possible.

On the other hand, CHARACTER SIGNAL DETECTING COIL is adapted to issue character timing pulses or signals by sensing the magnetic pieces provided on a timing belt, or the belt 20 shown in FIG. 1 and the output pulses are amplified by TIMING AMP so that "H" and "L" logic outputs are generated for actuating COUNTER so as to issue address signals. The address signals are fed to CPU and OUTPUT BUFFER MEMORY to control the actuation thereof.

MOTOR and MAGNETs for paper feed and carbon ribbon change and selection of each character, for example, the digit DIG "1" to "*n*" corresponding to the number of characters in one row, are controlled by the DRIVER TRANSISTORs for the desired operation of the printer.

Since the control per se is not the subject matter of the present invention, the detailed description thereof is omitted.

We claim:

1. Impact printing having a rotating printing drum bearing a plurality of axially extending rows of printing characters circumferentially arranged on the peripheral surface of said drum, the characters in any one row being identical to each other and different from the characters in other rows, a driving shaft adapted to be driven at a speed in synchronism with said drum, printing hammers each belonging to the respective character in each row for printing a selected character at the printing position of said printer during the rotation of said drum when said hammer is actuated, control levers each belonging to the respective printing hammer for actuating the same when driven, said driving shaft being provided with driving projection means for driving the respective control levers in such a manner that the same are actuated in synchronism with the arrival of the selected row of said drum at said printing position during the rotation of said drum, said control levers being normally held apart from said driving projection means so as to be inoperative by said driving projection means but, upon manuipulation of said printer for the required printing operation, selected one or ones of said control levers being brought to positions at which they are driven by said projection means thereby permitting required printing operation to be effected, wherein the improvement comprises:

said driving projection means being divided into at least a first and a second section, said first and said second sections being slightly shifted angularly around said shaft from each other, said first section extending along a first axial portion of said shaft, said second section extending along a second axial portion of said shaft, said section each having a length a least equal to the width of two adjacent rows, said first and said second portions being free of any other section along the same axial portion thereby avoiding excessive power required for the actuation of said hammers even though the same characters in one row are to be printed simultaneously while the printed characters in each row is substantially held in alignment with each other.

2. Printer according to claim 1, wherein the arrangement in each row of the respective characters is so selected that characters corresponding to one of said sections of said driving projection means are correspondingly shifted angularly from the characters corresponding the remaining section so that the printed characters in each row is held strictly in alignment with each other.

3. Printer according to claim 1, wherein said control levers are all uniformly associated with said driving shaft.

4. Printer according to claim 3, wherein said printer has magnets, armatures and select levers coupled with said control levers, and said select levers are uniformly aligned with each other and with said sections; and, said sections each extend partially along said driving shaft without overlapping each other, said sections being angularly displaced from each other so that one of said sections will engage a first group of said control levers and the other of said sections will engage a second group of said control levers in response to energization of said associated magnets.

* * * * *

UNITED STATES PATENT AND TRADEMARK OFFICE

CERTIFICATE OF CORRECTION

PATENT NO. : 4,089,263
DATED : May 16, 1978
INVENTOR(S) : Katsuhiko Okabe, et al It is certified that error appears in the above-identified patent and that said Letters Patent are hereby corrected as shown below:

Col. 5, Line 14 change "MAGNETs" to --MAGNETS--

Line 18 change "TRANSISTORs" to --TRANSISTORS--

Claim 1:

Col. 6, Line 14 change "section" to --sections--

Line 15 change "a" to --at--

Line 16 change "rows" to --characters--

Signed and Sealed this

Second Day of October 1979

[SEAL]

*Attest:*

RUTH C. MASON
*Attesting Officer*

LUTRELLE F. PARKER
*Acting Commissioner of Patents and Trademarks*